United States Patent [19]

Kostecki

[11] Patent Number: 4,793,712

[45] Date of Patent: Dec. 27, 1988

[54] GAS MIXER

[75] Inventor: Michael Kostecki, Wiesbaden-Delkenheim, Fed. Rep. of Germany

[73] Assignee: Perkin-Elmer-Metco GmbH, Hattersheim, Fed. Rep. of Germany

[21] Appl. No.: 842,084

[22] Filed: Mar. 20, 1986

[30] Foreign Application Priority Data

Apr. 1, 1985 [DE] Fed. Rep. of Germany ..... 3511927

[51] Int. Cl.[4] ..... B01F 3/02; B01F 5/06

[52] U.S. Cl. ..... 366/349; 48/180.1; 48/189.4

[58] Field of Search ..... 366/340, 349, 336, 176; 48/180.1, 189.1, 189.4, 189.6; 431/354, 355; 126/110 C

[56] References Cited

U.S. PATENT DOCUMENTS

| | | | |
|---|---|---|---|
| 1,676,237 | 7/1928 | Baker | 48/189.4 |
| 1,977,168 | 10/1934 | Brown | 48/180.1 |
| 3,816,062 | 6/1974 | Bouvier | 431/355 |
| 4,043,539 | 8/1977 | Gilmer et al. | 366/340 |
| 4,352,572 | 10/1982 | Chen et al. | 366/340 X |
| 4,475,821 | 10/1984 | Koch et al. | 366/340 X |

FOREIGN PATENT DOCUMENTS

| | | | |
|---|---|---|---|
| 564178 | 10/1958 | Canada | 366/340 |
| 2549617 | 8/1979 | Fed. Rep. of Germany . | |
| 109986 | 3/1944 | Sweden | 366/340 |
| 1206031 | 9/1970 | United Kingdom . | |
| 1395354 | 5/1975 | United Kingdom . | |
| 1402355 | 8/1975 | United Kingdom . | |

*Primary Examiner*—Harvey C. Hornsby
*Assistant Examiner*—Scott J. Haugland
*Attorney, Agent, or Firm*—H. S. Ingham; F. L. Masselle; E. T. Grimes

[57] ABSTRACT

Described is a gas mixer preferentially employed for mixing at least two gas flows. The gas mixer comprises a first filter adapted to have a first gas flow directed therethrough from a first surface to a second surface thereof. A second gas flow is directed along the second surface of the filter so as to entrain the first gas exiting therefrom. The resulting gas mixture is subsequently caused to pass through a second filter and, if need be, through one or more additional filters.

10 Claims, 2 Drawing Sheets

GAS MIXER

DESCRIPTION

Figure 1:
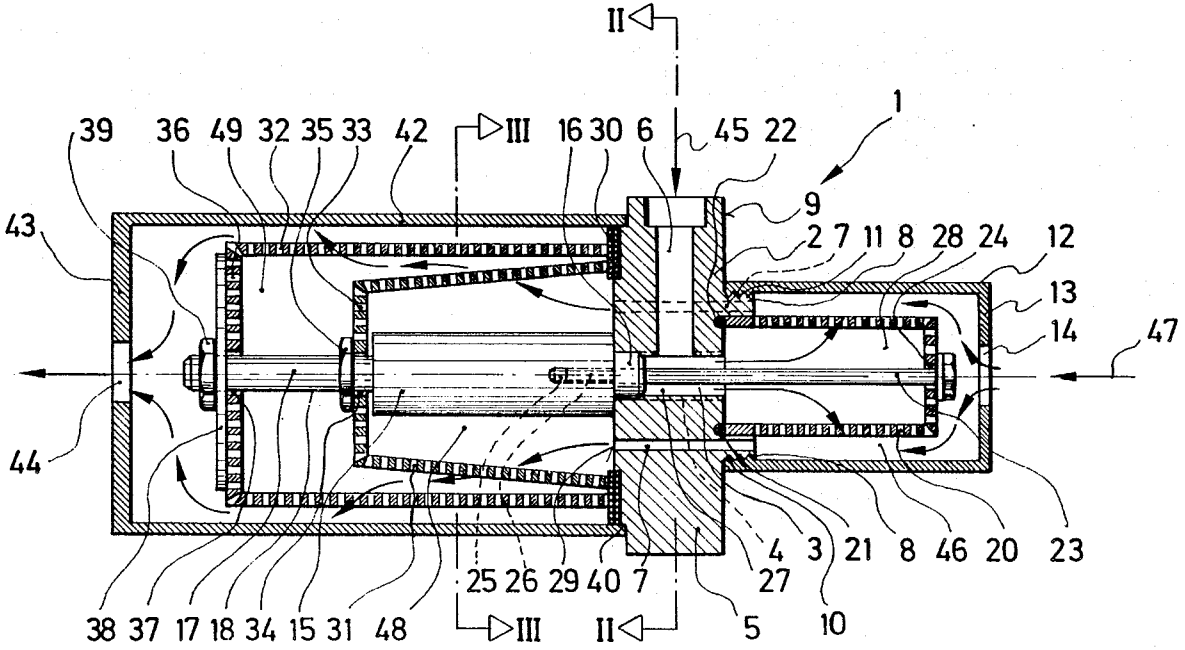

The present invention relates to a gas mixer for mixing at least two gas flows. In particular, the invention relates to a gas mixer which may be used in a plasma spraying process.

In a plasma spraying process, a non-transmitting direct current arc is generated by a high frequency energization of two electrodes within a nozzle, the shape of the cooled anode being effective to compress said arc. This compressed arc of high power density is effective to rapidly heat a gas flowing through said nozzle to very high temperatures, so that the gaseous mixture is partially ionized and converts to the plasma state for expanding out of said nozzle at a high velocity.

This plasma jet constitutes a highly effective tool for melt-coating suitable surfaces with metals, metal alloys, hard substances such as carbides and oxides and a number of certain synthetic materials when such coating materials are blown into the plasma jet in the form of a powder within the nozzle or outside thereof. The heat-melted powder particles impinge on a workpiece surface to form a spray coating thereon.

For producing and maintaining the plasma it is customary to employ gas mixtures selected on the base of a given problem to be solved for achieving an optimum solution with regard to various and partially contradictory requirements such as easy ignition, high temperature, high heat content, good heat transfer to the powdered material, desired or undesirable reactions with the powder particles, low cost and the like, such optimum solution being frequently not attainable with only a single gas.

A reproducible and constantly high quality of the coating is dependent, however, on the composition of the plasma jet being as uniform as possible over time and over its cross-sectional area. A thorough mixing of the gases employed prior to their entering the arc is therefore of particular importance.

The best-known principle for mixing gas flows is the one employed in a bunsen burner as explained for instance in U.S. Pat. No. 3,816,062, wherein a first gas flows at a determined velocity from a gas conduit into a nozzle, the sides of which are formed with openings permitting a second gas to be aspirated therethrough by the vacuum generated by the flow of the first gas so as to be entrained by the first gas flow and dispersed therein. In actual fact, however, this construction generally results in the first gas flow being only enveloped by a layer of the second gas, so that a thorough mixing effect is not achieved.

Also known already from DE-AS No. 25 49 617 is a gas mixer valve having two juxtaposed gas chambers adapted to be supplied with different gases. The two gas chambers are separated from one another by a thin partition, one side of the gas chambers being closed by a sliding valve body formed with a plurality of closely adjacent gas passages extending perpendicular to its sliding direction. Displacement of the sliding valve body permits the number of passages communicating with any of the chambers to be varied. In this manner, the ratio of the amounts of the gases from the first and second gas chambers may be varied by displacement of the sliding valve body. This gas mixer valve does not, however, enable the two gases to be thoroughly mixed.

It is therefore an object of the present invention to propose a gas mixer permitting a thorough mixing of at least two gas flows to be readily achieved.

This object is attained according to the invention by a gas mixer comprising a first filter adapted to have a first gas flow directed therethrough from a first surface to a second surface thereof, and to have a second gas flow directed along said second surface, and a second filter adapted to have the gas mixture formed of said gas flow directed along the second surface of the first filter and of said gas flow passing through said first filter directed therethrough.

Depending on the velocity of the gas flows to be mixed the mixing efficiency may advantageously be further improved by directing the gases exiting from said second filter through a third filter and if the need arises through still further filters.

According to a preferred embodiment of the invention, the gas mixer is characterized by comprising a first filter body enclosing an interior space and communicating with means for supplying a first gas flow thereto, a housing forming a space between itself and the outer surface of said first filter body, means for supplying a second gas flow to said space, a gas conduit communicating with said space and opening into an interior space defined by a second filter body, and a second housing enclosing said second filter body and communicating with a gas outlet conduit.

Each of the filters or filter bodies may consist of any conventional filter material. It has been found particularly advantageous, however, to employ a filter material consisting of a sintered metal or a sintered alloy. Particularly preferred in these cases is the employ of filters made of a sintered bronze.

In the case of the filters being made of a sintered material, the average pore size is preferably between 70 and 10 $\mu$m.

If there are a plurality of filters arranged in series, it has been found advantageous to select the average pore size of successive filters so as to decrease in the direction of the gas flow. In a preferred embodiment employing three filter bodies, the first, second and third filter bodies may have average pore sizes of 60, 45 and 20 $\mu$m, respectively.

The gas mixer according to the invention may be used for any application requiring a thorough mixing of two or more gas flows to be achieved. A preferred employ of the gas mixer according to the invention is in plasma flame spraying apparatus.

In these applications, particularly good results are obtained when mixing hydrogen and/or helium as the first gas flow and argon and/or nitrogen as the second gas flow.

Figure 2:
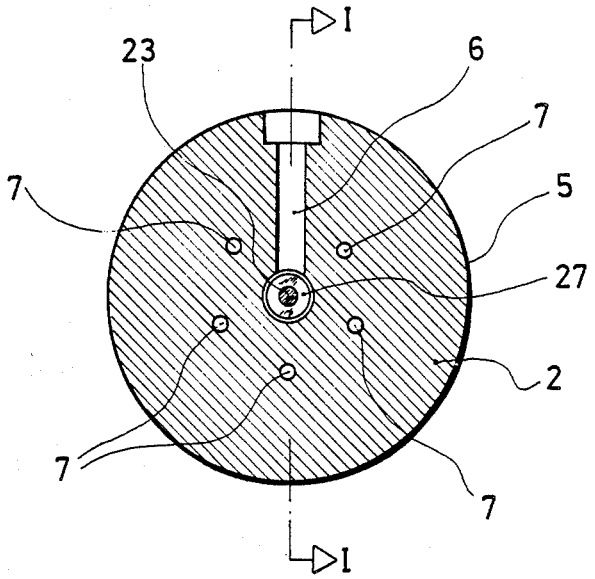
Figure 3:
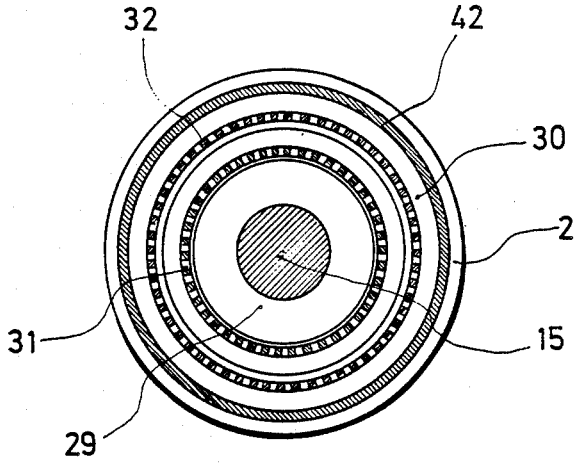

The invention shall now be described in detail with referance to a preferred embodiment shown by way of example in the accompanying drawings, wherein:

FIG. 1 shows an axial sectional view along the line 1—1 in FIG. 2 of an embodiment of a gas mixer according to the invention, FIG. 2 shows a cross-sectional view taken along the line II—II in FIG. 1, and FIG. 3 shows a sectional view taken along the line III—III in FIG. 1.

A gas mixer generally indicated at 1 in FIG. 1 comprises a base member 2 substantially formed as a circular disk having a longitudinal central bore 3 extending therethrough and formed with an internal thread 4. From the periphery 5 of base member 2 a radial bore 6 extends to central bore 3 so as to communicate therewith. Spaced from central bore 3 and parallel thereto, a plurality of passages 7 extend through base member 2.

At its righthand portion as seen in FIG. 1, base member 2 is formed with an annular projection 8 projecting from the plane 9 of the base member surface. The outer periphery of annular projection 8 is provided with a male thread 10 for engagement with a female thread 11 formed at the open end of a cylindrical housign 12. The general shape of housing 12 is that of a cylindrical cap, with the end opposite to the one having the female thread 11 being provided with an end wall 13 with a central gas supply opening 14 passing therethrough. The housing is preferably formed of a metal such as aluminum.

Provided on the side of base member 2 facing away from housing 12 is a bolt 15 the diameetr of which is larger than that of central bore 3. The end of bolt 15 facing towards base member 2 is provided with an externally threaded projection 16 for threaded engagement with the internal thread of central bore 3 in abutting engagement of a shoulder of bolt 15 with the surface of base member 2.

The end of bolt 15 facing away from base member 2 is formed with a coaxial reduced-diameter section 17 provided with external threads 18 on its periphery.

Disposed within housing 12 is a first filter body 20 substantially in the form of a cylinder having one closed end. The outer diameter of first filter body 20 is somewhat smaller than the interior diameter of annular projection 8 of base member 2. Base member 2 has an annular groove 21 for receiving an annular gasket 22 therein, for instance an O-ring or any other suitable sealing material such as a teflon ring. The free edge of filter body 20 is in sealing engagement with annular gasket 22.

The filter body itself is retained in position by a threaded bolt 23 passing through an opening 24 in its end wall and having its inner end formed with male threads 25 for threaded engagement with a female thread formed in a blind bore 26 of bolt 15. The diameter of threaded bolt 23 is smaller than that of longitudinal bore 3, so that the internal wall of bore 3 and the outer surface of bolt 23 define an annular space 27 providing communication between radial bore 6 and the interior space 28 of first filter body 20.

The side of base member 2 facing away from housing 12 is formed with a recess in surface 29 for receiving an annular gasket 30 therein. Sealingly engaged with annular gasket 30 are the annular terminal edges of a second and a third filter body 31 and 32, respectively. Second filter body 31 is of cup-shaped configuration with a slightly conical wall. Its end wall 33 is formed with an obening 34 for reduced-diameter section 17 of bolt 15 to extend therethrough. A nut 35 threaded onto reduced-diameter section 17 retains the free edge of second filter body 31 in sealing engagement with annular gasket 30. Third filter body 32 has the shape of a cylinder having one of its ends closed by an end wall 36 formed with an opening 37 for the reduced-diameter section 17 of bolt 15 to extend therethrough. With the interposition of a washer 38, a nut 39 on reduced-diameter section 17 is tightened against end wall 36 for retaining the free edge of third filter body 32 in sealing engagement with annular gasket 30.

An annular shoulder 40 of base member 2 is foremd with a male thread for threaded engagement with a female thread formed adjacent the open end of a cylindrical second housing 42. The end wall 43 of second housing 42 is provided with a passage 44 forming an outlet of the gas mixture.

The filter bodies are preferably made of a sintered bronze of a per se known type generally consisting of a copper tin alloy, although copper may also be alloyed with other metals. Sintering methods for the production of porous sintered materials are generally known. Sintered bodies are usually made by a powder-metallurgy process. The porosity of a sintered material depends both on the original particle size of the powdered material employed and on the heat treatment to which it is subjected.

Annular gaskets 22 and 30 are preferably made of a durably resilient material so as to ensure adequate sealing along the edges of the filter bodeis over a long period of time. An example for a particularly effective sealing material in this respect is teflon.

The mixing process proceeds in the following manner: a first gas flow indicated by arrow 45 is directed through radial bore 6 and annular passage 27 into interior space 28 of first filter body 20. The gas flow penetrates the porous wals of the filter body and enters the annular space 46 between the outer surface of first filter body 20 and the wall of housing 12. A second gas flow indicated by arrow 47 enters annular space 46 through opening 14 and flows along the outer surface of first filter body 20 so as to be mixed with the first gas exiting therefrom. The gas mixture then flows through passages 7 of base member 2 into the interior space of second filter body 31 whence it passes through the porous wall of second filter body 31 into a space 49 formed between the interior surface of third filter body 32 and the exterior surface of second filter body 31. The gas subsequently passes through the wall of third filter body 32 into the space defined between the interior wall of second housing 42 and the exterior surface of third filter body 32. The gas mixture finally leaves this space through the outlet opening 44 in housing end wall 43.

In a preferred embodiment, hydrogen or helium or a mixture of the two gases was used as the first gas flow, and argon or nitrogen or a mixture thereof was used as the second gas flow. The filter bodies had the following wall thicknesses and pore sizes:

| | Wall thickness | pore size |
|---|---|---|
| 1st filter body | 2 mm | 60 μm |
| 2nd filter body | 2 mm | 45 μm |
| 3rd filter body | 2.5 mm | 20 μm |

The material was sintered bronze in each case.

A highly effective mixing action was achieved even when the flow rate of the first gas varied between 0 and 100 l/min and that of the second gas varied between 10 and 200 l/min, any combination of flow rates within these ranges having been possible.

The above described arrangement merely represents a preferred embodiment. The described construction may in fact be varied in any suitable manner as long as it is ensured that a first gas flow is passed through a first filter while a second gas flows along the outer surface of such filter so as to entrain the first gas, the resulting mixture being subsequently passed through a second filter and, if need be, through one or more additional filters.

What is claimed is:

1. A gas mixer for mixing at least two gas flows, comprising a first filter body (20) surrounding an interior space (28) and communicating with a supply means (6,27) for a first gas flow and adapted to have said first gas flow directed therethrough from a first surface of said first filter body (20) to a second surface of said first filter body (20) and to have a second gas flow directed along said second surface to form a gas mixture with said first gas flow exiting from said second surface, a second filter body (31) adapted to have said gas mixture directed therethrough, a third filter body (32) surrounding said second filter body (31) to define a space (49) between itself and said second filter body (31), a first housing (12) forming a space (46) between itself and the outer surface of said first filter body (20), means (14) for supplying said second gas flow to said space (46), a gas conduit (7) communicating with said space (46) and opening into an interior space (48) defined by said second filter body (31), and a second housing (42) communicating with a gas discharge conduit (44) and surrounding said second filter body (31) and enclosing said third filter body (32) so as to form a space therebetween, wherein said filter bodies (20,31,32) consist of porous sintered metal or porous sintered alloy such that the average pore size of said filter bodies (20,31,32) decreases from said first towards said third filter bodies.

2. A gas mixer according to claim 1, characterized in that at least one of said filter bodies consists of a sintered bronze.

3. A gas mixer according to claim 1 wherein said filter bodies (20, 31, 32) have an average pore size between 70 and 10 μm.

4. A gas mixer according to claim 1 wherein said first filter body (20) has an average pore size of 60 μm.

5. A gas mixer according to claim 1 wherein said second filter body (31) has an average pore size of 45 μm.

6. A gas mixer according to claim 1 wherein said third filter body (32) has an average pore size of 20 μm.

7. A gas mixer according to claim 1 wherein for use in a plasma flame spraying apparatus.

8. A gas mixer according to claim 1 wherein for mixing hydrogen and/or helium as said first gas flow and argon and/or nitrogen as said second gas flow.

9. A gas mixer for mixing at least two gas flows, comprising:

a first filter body (20) surrounding an interior space (28) and communicating with supply means (6,27) for a first gas flow and adapted to have said first gas flow directed therethrough from a first surface of said first filter body (20) to a second surface of said first filter body (20) and to have a second gas flow directed along said second surface to form a gas mixture with said first gas flow exiting from said second surface;

a second filter body (31) adapted to have said gas mixture directed therethrough;

a cylindrical base member (2) defined by a periphery, a first base member surface and a second base member surface, and having a central bore (3) therethrough and a radial bore (6) extending from said central bore through said periphery and being receptive of a first gas flow source, and further having an annular projection (8) from said first base member surface with an outer periphery and an inner periphery, and a plurality of passages (7) extending through said base member such as to further extend through said annular projection to said second base member surface;

a cylindrical first housing (12) threaded to said outer periphery and having a first end wall (13) distal from said base member with a central inlet opening (14) therein receptive of a second gas flow source;

a first bolt (15) in threaded engagement with a portion of said central bore (3) and extending away from said second base member surface, and having a blind bore (26) extending axially from said central bore;

a second bolt (23) with a diameter smaller than said central bore (3) and in threaded engagement with said blind bore (26) extending away from said first base member surface; and a cylindrical second housing (42) in threaded engagement with said second base member surface and having a second end wall (43) distal from said base member (2) with a gas outlet passage (44) therein;

each of said filter bodies (20,31) consisting of a porous sintered metal or porous sintered alloy;

said first filter body (20) being generally cylindrical with a closed end and being retained on said base member (2) at said inner periphery of said annular projection (8) with said second bolt (23) and having an inner surface constituting said first surface of said first filter and an outer surface constituting said second surface of said first filter, said interior space (28) being defined within said first filter body in communication with said radial bore (6) by way of said central bore (3), and a first annular space (46) being defined between said outer surface and said first housing (12) and being in communication with said inlet opening (14) and with said plurality of passages (7); and said second filter body (31) being cup-shaped and retained on said second base member surface by said first bolt (15) within said second housing (42) to define a second annular space between said second filter and said first bolt and a further space between said second filter and said second housing, said second annular space being in communication with said plurality of passages.

10. A gas mixer according to claim 9 further comprising a cup-shaped third filter body (32) consisting of a porous sintered metal or porous sintered alloy, disposed between said second filter body (31) and said second housing (42) to define a third space between said second filter body and said third filter body, and a fourth space between said third filter body and said second housing in communication with said outlet passage (44).

* * * * *